US010443602B2

(12) United States Patent
Liu

(10) Patent No.: US 10,443,602 B2
(45) Date of Patent: Oct. 15, 2019

(54) BUILT-IN ELECTRIC AIR PUMPS FOR INFLATING OBJECTS

(71) Applicant: Bestway Inflatables & Material Corp., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 764 days.

(21) Appl. No.: 14/917,272

(22) PCT Filed: Mar. 6, 2014

(86) PCT No.: PCT/CN2014/000204
§ 371 (c)(1),
(2) Date: Mar. 8, 2016

(87) PCT Pub. No.: WO2015/054973
PCT Pub. Date: Apr. 23, 2015

(65) Prior Publication Data

US 2016/0215780 A1 Jul. 28, 2016

(30) Foreign Application Priority Data

Oct. 18, 2013 (CN) ..... 2013 2 0646019 U

(51) Int. Cl.
*F04D 25/06* (2006.01)
*F04D 25/08* (2006.01)
(Continued)

(52) U.S. Cl.
CPC ..... *F04D 25/068* (2013.01); *A47C 27/082* (2013.01); *F04D 17/168* (2013.01);
(Continued)

(58) Field of Classification Search
CPC ..... F04D 25/06; F04D 25/068; F04D 25/084; F04D 27/00; F04D 27/005; F04D 29/053;
(Continued)

(56) References Cited

U.S. PATENT DOCUMENTS 2,781,056 A * 2/1957 Carufel ..... F16H 3/00 137/625.15
3,057,300 A * 10/1962 Ulbing ..... F02M 59/00 137/565.27
(Continued)

FOREIGN PATENT DOCUMENTS

CN 100410545 C 8/2008
CN 101749262 B 12/2011
(Continued)

OTHER PUBLICATIONS

International Search Report from PCT Patent Application No. PCT/CN2014/000204 dated Jul. 8, 2014, application now published as International Publication No. WO2015/054973 on Apr. 23, 2015.

*Primary Examiner* — Carlos A Rivera
*Assistant Examiner* — Wayne A Lambert
(74) *Attorney, Agent, or Firm* — AJ Moss; Dickinson Wright PLLC

(57) ABSTRACT

A built-in electric air pump for an inflating object includes a pump casing, a switch hand-wheel, a connection pipe, an air passage switching device, an air pump, and an air valve and a power switch. The pump casing includes a box-shaped chamber. The switch hand-wheel is provided at an external lateral side of the panel. The air passage switching device is provided with an internal pipe having a first opening and a second opening respectively arranged at an upper end and a lower end of the internal pipe. The first opening communicates with outside of the inflating object, and the second opening communicates with the air valve. A diaphragm is provided inside the internal pipe. A first venting hole and a
(Continued)

second venting hole are respectively provided on internal walls at two sections of the internal pipe above and below the diaphragm. An external sleeve is provided outside the internal pipe. The lower end of the external sleeve is fixedly connected to the pump casing. The lower end of the external sleeve correspondingly communicates with the air valve. A wall of the external sleeve is provided with an air outlet communicating with an air inlet of the air pump and an air inlet communicating with an air outlet of the air pump. An upper end of the connection pipe is connected to and communicated with the switch hand-wheel, and the lower end of the connection pipe is muff-coupled with the upper end of the internal pipe. The diaphragm of the internal pipe contacts a valve rod of the air valve such that the valve is opened by an applied external force and the diaphragm and the value are moved together.

13 Claims, 7 Drawing Sheets

(51) Int. Cl.

| | |
|---|---|
| ***F04D 27/00*** | (2006.01) |
| ***A47C 27/08*** | (2006.01) |
| ***F04D 17/16*** | (2006.01) |
| ***F04D 29/053*** | (2006.01) |
| ***F04D 29/08*** | (2006.01) |
| ***F04D 29/28*** | (2006.01) |
| ***F04D 29/42*** | (2006.01) |
| ***F04D 29/50*** | (2006.01) |

(52) U.S. Cl.
CPC ..... *F04D 25/084* (2013.01); *F04D 27/00* (2013.01); *F04D 27/005* (2013.01); *F04D 29/053* (2013.01); *F04D 29/083* (2013.01); *F04D 29/28* (2013.01); *F04D 29/4206* (2013.01); *F04D 29/503* (2013.01)

(58) Field of Classification Search
CPC ..... F04D 29/083; F04D 29/168; F04D 29/28; F04D 29/4206; F04D 29/503; Y10T 137/86533; Y10T 137/86638; Y10T 137/86115
See application file for complete search history.

(56) References Cited

U.S. PATENT DOCUMENTS 3,146,794 A * 9/1964 Hollman ..... F16K 11/0743 137/625.15
3,563,676 A * 2/1971 Coovert et al. ..... A63H 27/10 141/353
3,973,592 A * 8/1976 Cleaver ..... F16K 11/0833 137/625.43
4,157,113 A * 6/1979 Karran ..... B60H 1/00064 165/42
4,285,365 A * 8/1981 Coats ..... F16K 11/0856 137/625.15
6,142,181 A * 11/2000 Schumacher ..... F16K 11/0716 137/625.21
6,152,176 A * 11/2000 Lin ..... A61G 7/05776 137/624.11
6,530,751 B1 * 3/2003 Song ..... F04D 25/06 137/522
6,679,686 B2 * 1/2004 Wang ..... F04D 23/008 415/203
6,698,046 B1 * 3/2004 Wu ..... A47C 27/082 137/625.15
6,733,254 B1 * 5/2004 Yen ..... F04D 29/601 415/206
6,955,529 B2 * 10/2005 Tsai ..... F04B 39/00 417/360
6,990,700 B2 * 1/2006 Chung ..... A45B 19/02 137/565.11
7,020,921 B2 * 4/2006 Wang ..... A47C 20/048 5/706
7,410,146 B2 * 8/2008 Huang ..... F16K 3/265 251/144
7,475,443 B2 * 1/2009 Wang ..... H01H 35/245 200/82 R
7,588,425 B2 * 9/2009 Chung ..... A47C 27/082 417/315
2003/0183287 A1 * 10/2003 Wu ..... F04D 27/00 137/625.21
2006/0222535 A1 * 10/2006 Liu ..... F04D 25/08 417/423.1
2007/0104592 A1 * 5/2007 Wu ..... A47C 27/082 417/321
2010/0247337 A1 * 9/2010 Tsai ..... A47C 27/082 417/239
2010/0247355 A1 9/2010 Pan
2010/0247356 A1 9/2010 Tsai
2011/0020149 A1 1/2011 Tsai
2011/0158834 A1 * 6/2011 Pan ..... F04D 25/0673 417/423.14

FOREIGN PATENT DOCUMENTS

| | | |
|---|---|---|
| CN | 202228387 U | 5/2012 |
| CN | 202758434 U | 3/2013 |
| EP | 3059451 A1 | 8/2016 |
| WO | WO 2008/037136 A1 | 4/2008 |
| WO | WO 2015/054973 A1 | 4/2015 |

* cited by examiner

BUILT-IN ELECTRIC AIR PUMPS FOR INFLATING OBJECTS

RELATED FIELD

The present disclosure relates to an electric air pump, and more particularly relates to a built-in electric air pump for an inflating object.

BACKGROUND

Inflating products are characterized by attributes such as providing the portable and packing convenience, and thus are more and more popular for consumers. Inflating products in markets, for example, inflating mattresses, airbeds, inflating sofas, inflating toys, are welded-formed by PVC adhesive tape or PU adhesive tape in a high frequent melting manner. By inflating the chamber via an air valve, the inflating products can be incorporated into various products of specific shapes. In many years ago, most of the inflating products have adopted a manual air pump and a foot air pump, which takes not only a longer time but also a great deal of efforts. Thereafter, external electric air pumps have been developed. However, the external electric air pump though greatly save the efforts, but it is still troublesome that the users have to manually align the air nozzle with the air valve of the inflating products. It can be understood that air leakage may happen when the air nozzle is pulled out from the air valve upon completing the inflation operations. Also, the same efforts and time are needed for the inflating products when executing the inflation or deflation via an air valve. Currently, in markets, some of the inflating mattresses and airbeds start to adopt a variety of built-in electric air pumps fixedly installed on the inflating mattresses or the airbeds. For example, China Patent No.: 01129383 has disclosed a built-in electric air pump that can be partially detachable. However, the operations of the electric air pump are complicated and the performance of the airtightness is not good enough. Thus, such electric air pump has been phased out from the market. A newer built-in electric air pump is configured with an air passage switching device. With such configurations, it is easier to switch between the operations, including inflation, deflation and shutdown. However, such built-in electric air pump has disadvantages, such as complicated structure, a large pressure loss, a great deal of components, large dimension, and high manufacturing cost, or the like.

SUMMARY OF INVENTION

The object of the present disclosure is to overcome the above problems.

In one aspect, a built-in electric air pump for an inflating object includes: a pump casing, a switch hand-wheel, a connection pipe, an air passage switching device, an air pump, an air valve and a power switch; the pump casing including a box-shaped chamber; the connection pipe, the air passage switching device and the air pump being provided within the chamber of the pump casing; the air valve being provided at bottom of the pump casing; a panel being provided at a top portion of the pump casing, and the switch hand-wheel being provided at a lateral side of the panel; the air passage switching device being provided with an internal pipe having a first opening and a second opening respectively arranged at an upper end and a lower end of the internal pipe, the first opening communicating with outside of the inflating object via the connection pipe, and the second opening communicating with the air valve; a diaphragm being provided inside the internal pipe for separating inside of the internal pipe into two sections located in up-down direction, and the two sections not communicating with each other, and a first venting hole and a second venting hole being respectively provided on internal walls at two sections of the internal pipe above and below the diaphragm; an external sleeve being provided outside the internal pipe, a third opening and a fourth opening being respectively provided at the upper end and the lower end of the external sleeve, and an inner wall of the external sleeve engaging with an outer wall of the internal pipe; the lower end of the external sleeve being fixedly connected to the pump casing, the lower end of the external sleeve correspondingly communicating with the air valve, and a wall of the external sleeve being provided with an air outlet communicating with an air inlet of the air pump, and the wall of the external sleeve being provided with an air inlet communicating with an air outlet of the air pump; an upper end of the connection pipe being connected to and communicating with the switch hand-wheel, and the lower end of the connection pipe being muff-coupled with the upper end of the internal pipe; and the diaphragm of the internal pipe contacting an valve rod of the air valve such that the valve being opened by an applied external force and the diaphragm and the value being moved together.

In such embodiment, the internal pipe of the air passage switching device includes three variable positions, and when the internal pipe is at a first position, the first venting hole and the second venting hole of the internal pipe respectively communicate with the air outlet and the air inlet of the external sleeve such that air flows from outside of the inflating object to the inside of the inflating object; when the internal pipe is at a second position, the first venting hole and the second venting hole of the internal pipe respectively communicate with the air inlet and the air outlet of the external sleeve such that the air flows from the inside of the inflating object to the outside of the inflating object; and when the internal pipe is at a third position, both the first venting hole and the second venting hole of the internal pipe have not communicated with the air inlet and air outlet of the external sleeve.

In such embodiment, an outer surface of the internal pipe of the air passage switching device is provided with at least one first slider matching with the connection pipe and one second slider matching with the external sleeve. In such embodiment, a wall of the external sleeve of the air passage switching device is provided with a laterally-slidable waved chute lower at two lateral ends and higher at middle, and the waved chute matches with a second slider of the internal pipe.

In such embodiment, at least one linear groove is provided at a lower part of an inner wall of the connection pipe, and the at least one linear groove matches with a first slider of the internal pipe.

In such embodiment, the internal pipe is provided with a first slider and a second slider with a flange therebetween, an arcuate piece is provided at an edge of a top surface of the flange, and the arcuate piece moves together with the power switch arranged at a side of the arcuate piece.

In such embodiment, a flange having a diameter larger than an opening of the front panel is provided at a top end of the connection pipe, and at least one boss being fixedly connected to the switch hand-wheel is provided on an upper surface of the flange.

In such embodiment, the air pump includes a blade cap fixedly connected to the pump casing, a blade provide within the blade cap, and a motor provided within the chamber of the pump casing, the blade cap is provided with an air pump inlet and an air pump outlet, and an end of a shaft of the motor is connected to the blade by passing through the blade cap.

In such embodiment, the air valve is provided at bottom of the pump casing, and the air valve includes a valve piece, a sealing ring, a valve rod, a spring and a valve rod cap, an air valve opening of the pump casing is provided with an air valve supporting bracket, a through hole is provided at a center of the air valve supporting bracket, the valve rod is provided within the through hole of the air valve supporting bracket, upper and lower ends of the valve rod are respectively provided with the valve rod cap and the valve piece, the sealing ring is provided at a rim of the valve piece, the valve rod cap is muff-coupled between a periphery of the valve rod, the air valve supporting bracket and the valve rod cap, a meshed protection cap for protecting the air valve is provided at the air valve opening of the pump casing. In such embodiment, the switch hand-wheel is provided with a venting pipe.

According to the present disclosure, the built-in air pump may easily switch between the functions including inflation, deflation, and shutdown, which results in more efficient operations such as inflation and deflation. In addition, the built-in air pump also has advantages such as reasonable structure, fewer components, easily manufactured and assembled, and lower manufacturing cost.

In Figures: 1 pump casing, 11 chamber, 12 a front panel, 121 opening of the front panel, 2 switch hand-wheel, 21 venting pipe of the switch hand-wheel, 3 connection pipe, 31 flange of the connection pipe, 32 linear groove, 33 upper opening, 34 lower opening, 35 boss, 4 air passage switching device, 41 internal pipe, 411 first opening of the internal pipe, 412 second opening of the internal pipe, 413 diaphragm, 414 first venting hole of the internal pipe, 415 second venting hole of the internal pipe, 416 first slider of the internal pipe, 417 second slider of the internal pipe, 418 flange of the internal pipe, 419 arcuate piece, 42 external sleeve, 421 third opening of the external sleeve, 422 fourth opening of the external sleeve, 423 first air outlet of the external sleeve, 424 second air outlet of the external sleeve, 425 first air inlet of the external sleeve, 426 second air inlet of the external sleeve, 427 waved chute of the external sleeve, A1 first lower point of the waved chute of the external sleeve, A2 second lower point, B higher point, 428 flange of the external sleeve; 5 air pump, 51 blade cap, 52 air inlet of the air pump, 53 first air outlet of the air pump, 54 second air outlet of the air pump, 55 blade, 56 motor, 57 shaft, 6 air valve, 61 air valve opening, 62 air valve supporting bracket, 621 through hole of the air valve supporting bracket, 63 valve piece, 64 ring, 65 valve rod, 66 spring, 67 valve rod cap, 68 protection cap, 7 power switch

DESCRIPTION OF THE PREFERRED EMBODIMENT

It will describe the present disclosure in accompany with the drawings below.

Figure 1:
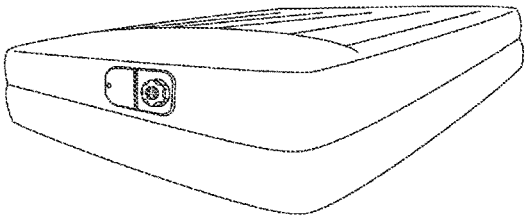
FIG. 1 is a schematically external view which shows an electric air pump of the present disclosure being installed on the inflating mattresses.
Figure 2:
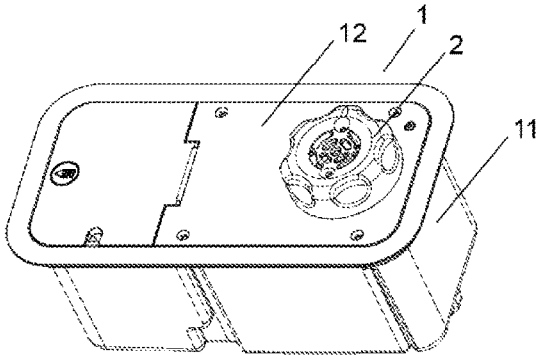
FIG. 2 is an external view of the electric air pump of the present disclosure.
Figure 3:
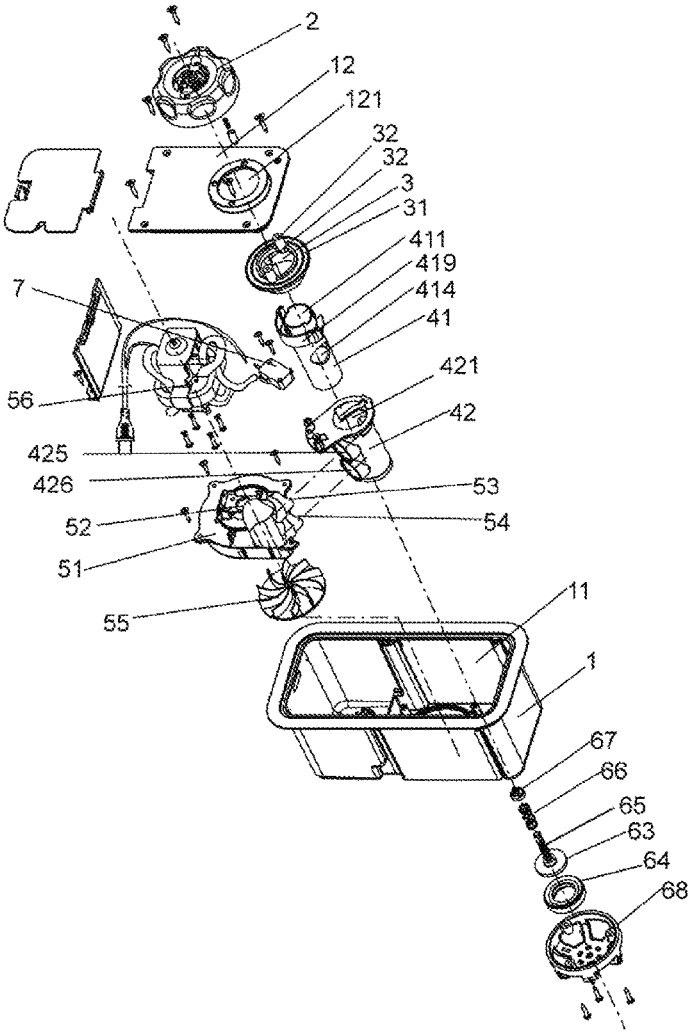
FIG. 3 is an exploded view of the electric air pump of the present disclosure.
Figure 4:
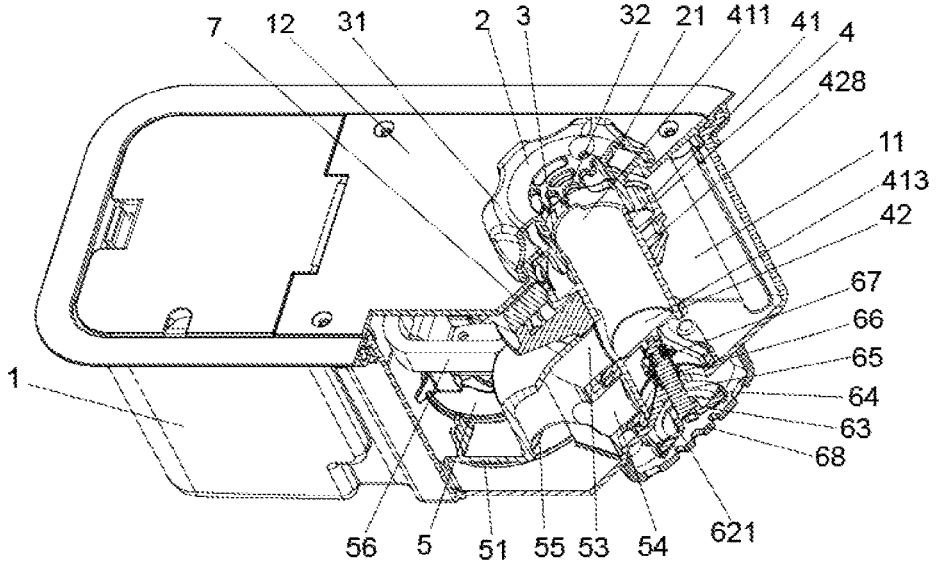
FIG. 4 is a partially cross-sectional view of the electric air pump of the present disclosure.
Figure 5:
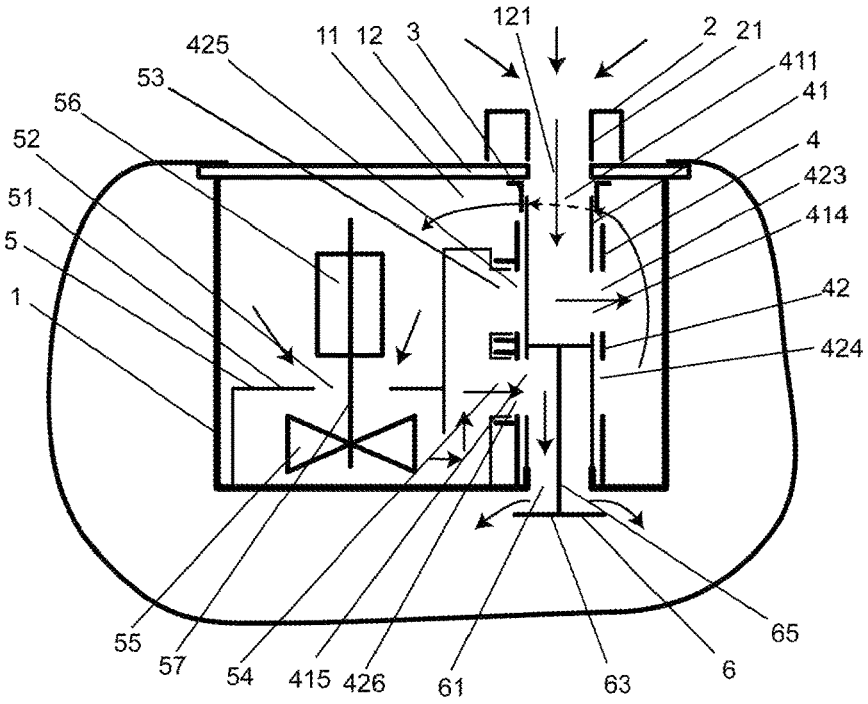
FIG. 5 is a schematic view of the electric air pump of the present disclosure in an inflation state.

See FIG. 1, the build-in electric air pump for an inflating object of the present disclosure is usually installed at a periphery of an inflating mattress or an airbed, and see FIGS. 3, 4, this embodiment includes a pump casing 1, a switch hand-wheel 2, a connection pipe 3, an air passage switching device 4, an air pump 5, an air valve 6 and a power switch 7. The pump casing 1 is a container having a box-shaped chamber, and the connection pipe 3, the air passage switching device 4 and the air pump 5 are provided in a chamber 11 of the pump casing 1. A front panel 12 is provided at a top portion of the pump casing 1, and the switch hand-wheel 2 is provided at a lateral side of the front panel 12. The air valve 6 is provided at a bottom of the pump casing 1.

The air passage switching device 4 is a device being provided within the electric air pump. The air passage switching device 4 cooperatively operates with the air pump 5 to change an air flowing direction by changing an air passage so as to provide three functions of the electric air pump, including inflation, deflation, and shutdown. See FIGS. 6,7,9,10,12,13, and 14, the air passage switching device 4 is provided with an internal pipe 41 and an external sleeve 42. The internal pipe 41 has a first opening 411 and a second opening 412 arranged at an upper and a lower ends of the internal pipe 41, respectively. The first opening 411 communicates with outside of the inflating object via the connection pipe 3, and the second opening 412 communicates with the air valve 6. An outer surface of the internal pipe 41 is provided with a first slider 416 matching with the connection pipe 3, a second slider 417 matching with the external sleeve 42, and a flange 418 being arranged between the first slider 416 and the second slider 417. An arcuate piece 419 is provided at an edge of a top surface of the flange 418, and a diaphragm 413 is provided inside the internal pipe 41 for separating inside of the internal pipe 41 into two sections located in up-down direction, and the two sections are isolated from each other. A first venting hole 414 and a second venting hole 415 are respectively provided on internal walls at two sections of the internal pipe 41 above and below the diaphragm 413. The first venting hole 414 and the second venting hole 415 open in opposite directions. The external sleeve 42 of the internal pipe 41 is muff-coupled outside the internal pipe 41. A third opening 421 and a fourth opening 422 are respectively provided at the upper end and the lower end of the external sleeve 42. An inner wall of the external sleeve 42 is closely adjacent to an outer wall of the internal pipe 41. The internal pipe may move upward and down, or may rotate within the external sleeve 42. The upper end of the external sleeve 42 is provided with a flange 428, and the lower end of the external sleeve 42 is fixedly connected to the pump casing 1. The air valve 6 is positioned at an inner side of the fourth opening 422 at the lower end of the external sleeve 42. A first air inlet 425 and a second inlet 426, which are positioned in up-down direction and adjacent to each other, and a first air outlet 423 and a second air outlet 424 are provided at a wall of the external sleeve 42. The wall of the external sleeve 42 is provided with a laterally—slidable waved chute 427 which is lower at two lateral ends and higher at middle. The waved chute 427 matches with the second slider 417 on the internal pipe 41 and may accommodate the internal pipe 41 such that the internal pipe 41 may slide within the waved chute 427. Based on above structure, when the internal pipe 41 is rotated so that the second slider 417 of the internal pipe 41 is moved to a first lower point A1 of the waved chute 427 of the external sleeve 42, the lower surface of the flange 418 of the internal pipe 41 abuts against the upper surface of the flange 428 of the external sleeve 42, and that the first venting hole 414 of the internal pipe 41 corresponds to the first air outlet 423 of the external sleeve 42, the second venting hole 415 of the internal pipe 41 corresponds to the second air inlet 426 of the external sleeve 42, and the second air outlet 424 and the second air inlet 426 of the external sleeve 42 are blocked by the wall of the internal pipe 41. When the internal pipe 41 is rotated and the second slider 417 of the internal pipe 41 is moved to a second lower point A2 of the waved chute 427 of the external sleeve 42, the lower surface of the flange 418 of the internal pipe 41 abuts against the upper surface of the flange 428 of the external sleeve 42. The first venting hole 414 of the internal pipe 41 corresponds to the first air inlet 425 of the external sleeve 42, the second venting hole 415 of the internal pipe 41 corresponds to the second air outlet 426 of the external sleeve 42, and the first air outlet 423 and the second air inlet 426 of the external sleeve 42 are blocked by the wall of the internal pipe 41. In actual use, the internal pipe 41 may be rotated to change the corresponding relationship between the first venting hole 414, the second venting hole 415 of the internal pipe 41 and the first air outlet 423, the second outlet 424, the first inlet 425, the second inlet 426 of the external sleeve 42 such that the air passage may be switched. An outer surface of the arcuate piece 419 of the internal pipe 41 is provided with the power switch 7. When the internal pipe 41 is rotated, the arcuate piece 419 contacts with the power switch 7 so as to connect or cut off a power source.

Figure 6:
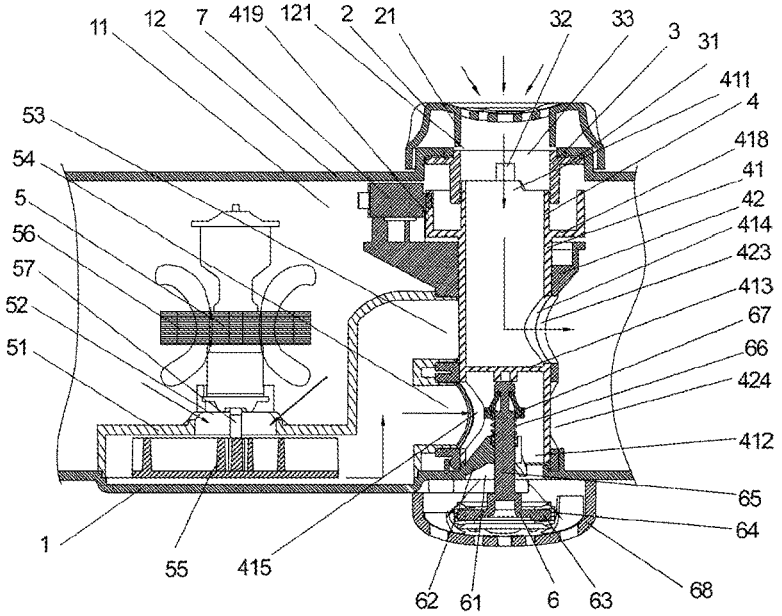
FIG. 6 is a cross-sectional view of the electric air pump of the present disclosure in the inflation state.
Figure 7:
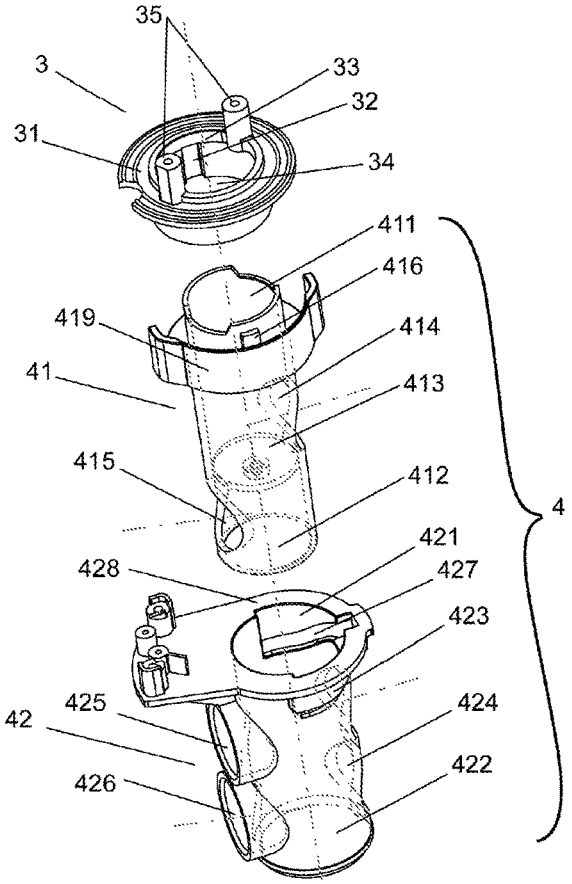
FIG. 7 is an exploded view of a connection pipe, an internal pipe and an external sleeve when the electric air pump of the present disclosure is in the inflation state.
Figure 8:
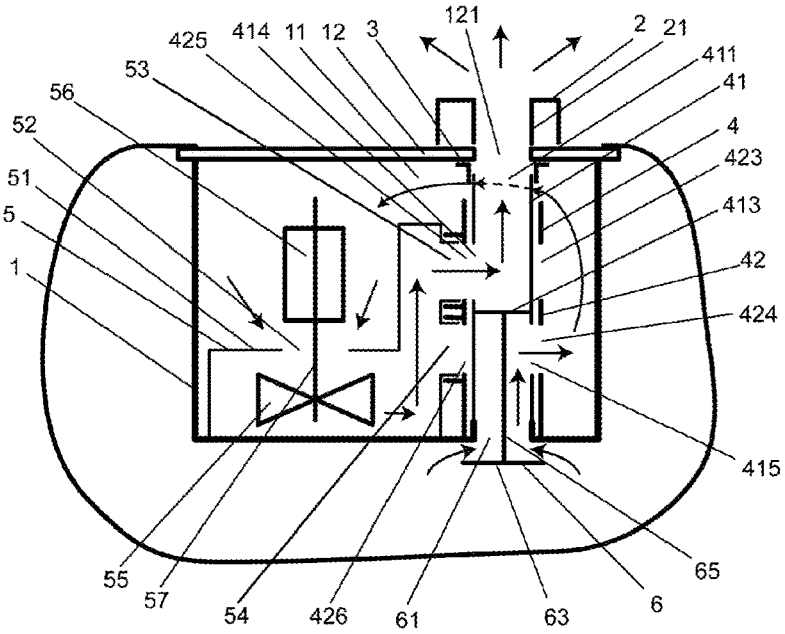
FIG. 8 is a schematic view of the electric air pump of the present disclosure in a deflation state.
Figure 9:
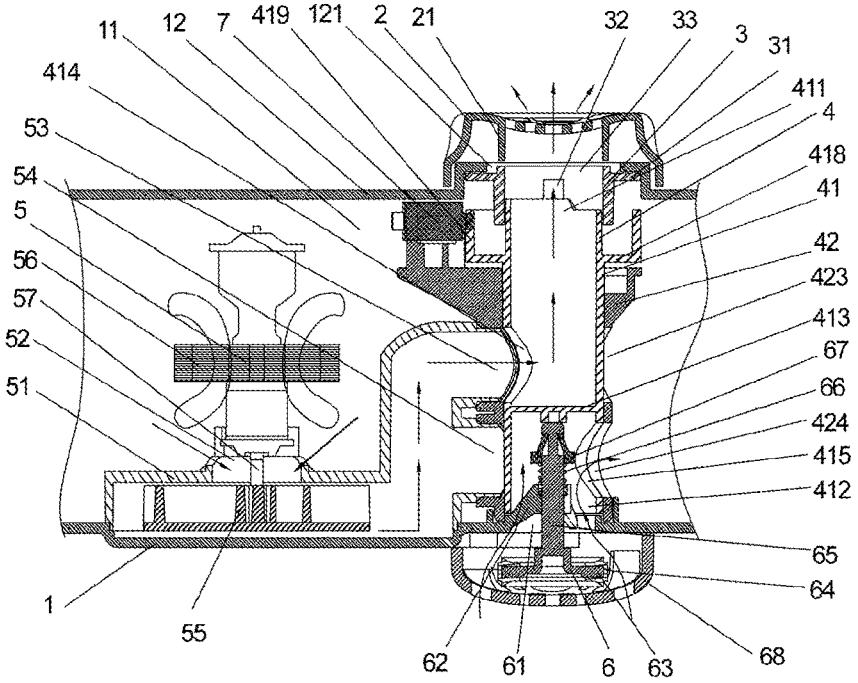
FIG. 9 is a cross-sectional view of the electric air pump of the present disclosure in the deflation state.
Figure 10:
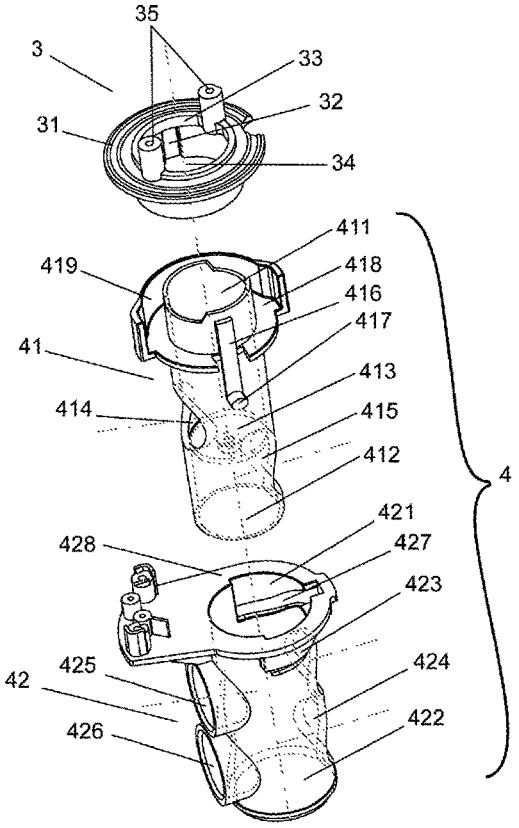
FIG. 10 is an exploded view of the connection pipe, the internal pipe and the external sleeve when the electric air pump of the present disclosure is in the deflation state.
Figure 11:
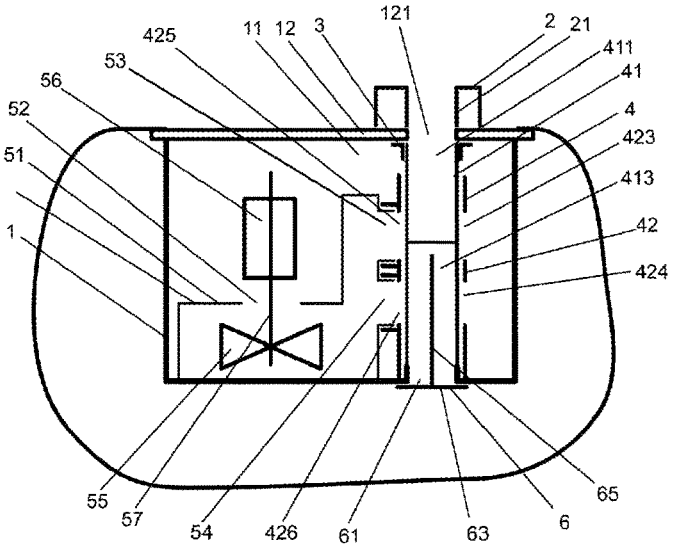
FIG. 11 is a schematic view of the electric air pump of the present disclosure in a shutdown state.
Figure 12:
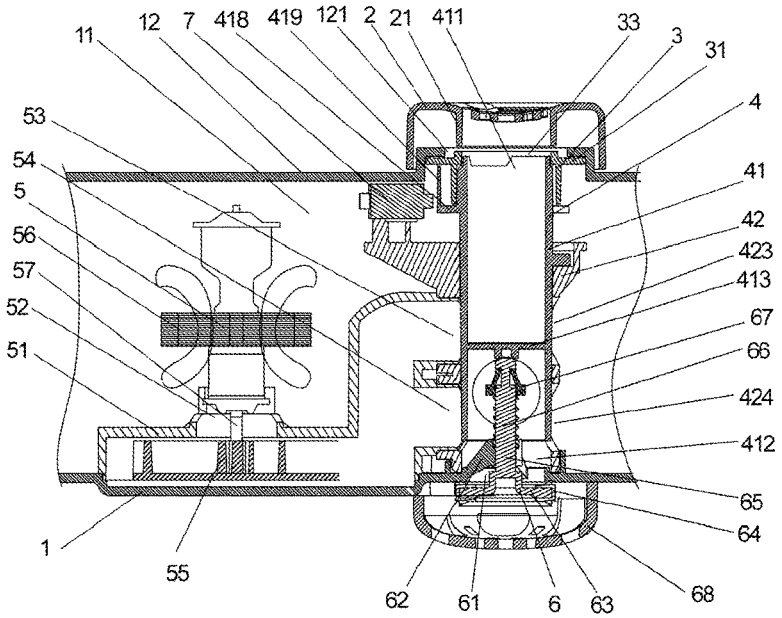
FIG. 12 is a cross-sectional view of the electric air pump of the present disclosure in the shutdown state.
Figure 13:
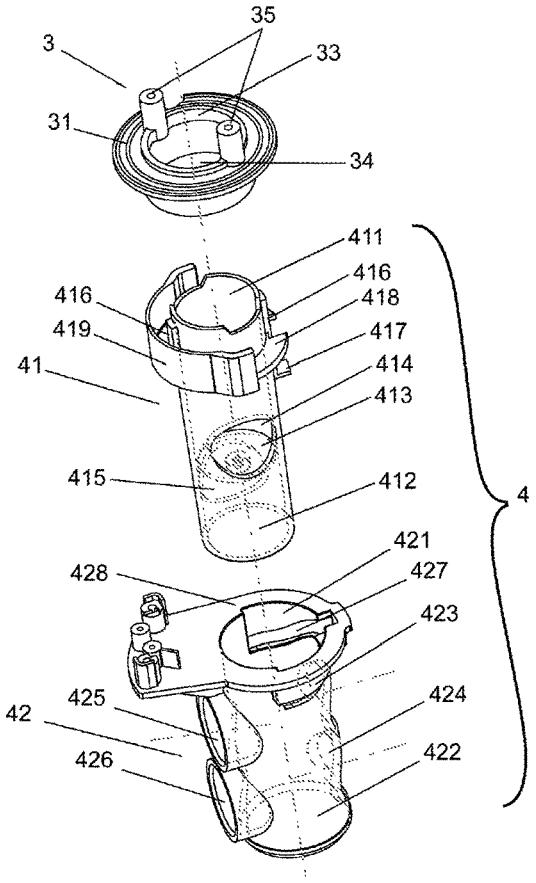
FIG. 13 is an exploded perspective view of the connection pipe, the internal pipe and the external sleeve when the electric air pump of the present disclosure is in the shutdown state.
Figure 14:
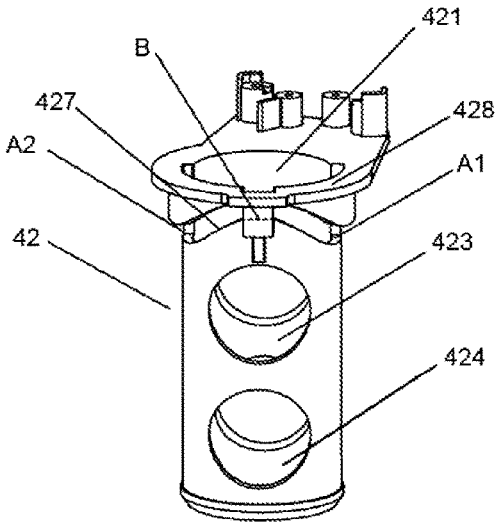
FIG. 14 is a structural view of the external sleeve of the electric air pump of the present disclosure.
Figure 15:
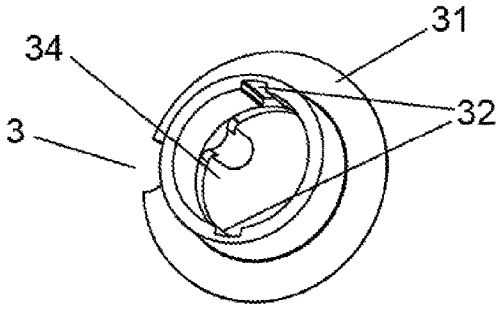
FIG. 15 is a structural view of the connection pipe of the electric air pump of the present disclosure.
Figure 16:
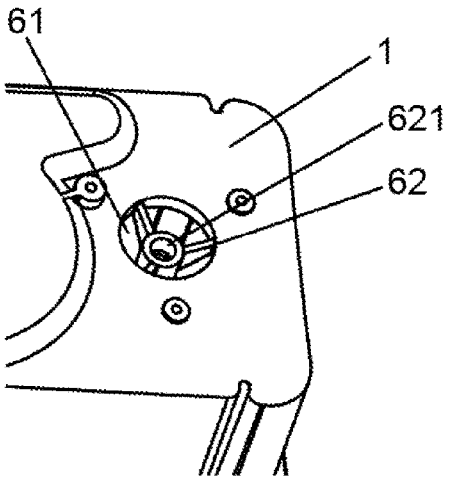
FIG. 16 is a structural view of an air valve opening of the electric air pump of the present disclosure.

See FIG. 6, the air pump 5 includes a blade cap 51 fixedly connected to the pump casing 1. An independent chamber is formed between the blade cap 51 and the pump casing 1. The blade cap 51 is provided with an air inlet 51, a first air outlet 53, and a second outlet 54. The air inlet 52 of the air pump communicates with the first air outlet 423 and the second air outlet 424 of the external sleeve 42 of the air passage switching device 4, and the first air outlet 53 and the second air outlet 54 of the air pump 5 are connected to the first air inlet 425 and the second air inlet 426 of the external sleeve 42 of the air passage switching device 4. A blade 55 is provided within the blade cap 51, and a motor 56 is installed on the blade cap 51. A shaft 57 of the motor 55 passes through the air inlet 52 of the blade cap 51 and connects to the blade 55 within the blade cap 51. During operations of the motor 56, the air is sucked from the air inlet 52 of the air pump into the blade cap 51, and then is deflated from the first air outlet 52 or the second air outlet 54 of the air pump 5 after being pressurized by the blade 55. The first air outlet 53 and the second air outlet 54 of the air pump 5 are located near a tangent of the blade 55 to reduce a loss of air pressure so as to improve the efficiency of the air pump 5. The motor 56 is provided near the air inlet 52 of the air pump such that the heat generated during the operations of the motor 56 may be efficiently dissipated. In this way, the, life cycle of the motor 56 may be extended.

See FIGS. 6,7,10, and 15, the connection pipe 3 is provided at an inner side of the front panel 12 of the pump casing 1. A flange 31 is provided at a top end of the connection pipe 3 with a flange 31 having a diameter larger than an opening 121 of the front panel 12. The surface of the flange 31 is closely adjacent to the front panel 12 of the pump casing. Two bosses 35 provided on an upper surface of the flange 31 pass through the opening 121 of the front panel 12 to connect to the switch hand-wheel 2. An upper opening 33 at an upper end of the connection pipe 3 corresponds to the opening 121 of the front panel, and the upper opening 33 communicates with a venting pipe 21 of the switch hand-wheel 2. The lower end of the connection pipe 3 is muff-coupled with the upper end of the internal pipe 41 of the air passage switching device 4. A linear groove 82 is provided on the inner wall of the connection pipe 3 for accommodating the second slider 417 of the internal pipe 41, and the second slider 417 may axially slide within the groove 82.

See FIGS. 3, 6,9,12, and 16, the air valve 6 is provided at bottom of the pump casing 1. An air valve supporting bracket 62 is provided at an air valve opening 61, and the air valve supporting bracket 62 has a through hole 621 arranged at a center thereof. A valve rod 65 is provided in the through hole 621 of the air valve supporting bracket 62, and the valve rod 65 may slide along an axial direction. Upper and lower ends of the valve rod 65 are respectively provided with a valve rod cap 67 and a valve piece 63 fixedly connected to the valve rod 65. The upper end of the valve rod 65 extends into the internal pipe 41 of the air passage switching device 4 so as to be close to the diaphragm 413 of the internal pipe 41. A sealing ring 64 is provided at a rim of the valve piece 63. A spring 66 is muff-coupled between a periphery of the valve rod 65, the air valve supporting bracket 62 and the valve rod cap 67. Based on above structure of the air valve 6, when there is no external force applied on the air valve 6, the valve piece 63 is driven to cover the air valve opening 61 due to elastic forces of the spring 66, so that the air valve 6 is in a closed state. When the internal pipe 41 of the switching device 4 moves downwards, the diaphragm 413 of the internal pipe 41 contacts the valve rod 65 and applies a downward force to the valve rod 65, so that the air valve 6 is opened. When the air valve 6 is opened, the inside of the inflating object communicates with the external, and when the air valve 6 is closed, the inside of the inflating object is isolated from the external.

According to above structure, the switch hand-wheel 2, the connection pipe 3, the internal pipe 41 of the air passage switching device 4, the air valve 6 and the power switch 7 form a mechanical linkage. When air is inflated into the inflating object, the switch hand-wheel 2 is rotated from a closed position to an inflation shift, and the switch hand-wheel 2 drives the connected connection pipe 3 to move together. The connection pipe 3 drives the internal pipe 41 of the air passage switching device 4 to rotate together, and the arcuate piece of the internal pipe 41 triggers the power switch 7 to turn on the power source. The air pump 5 starts to operate, and then the second slider 417 of the internal pipe 41 laterally slides to the first lower point A1 within the waved chute 427 of the external sleeve 42. The internal pipe 41 axially moves downward in the external sleeve 42 along therewith, and the diaphragm 413 opens the air valve 6 to make it in an open state. Meanwhile, the first venting hole 414 of the internal pipe 41 of the air passage switching device 4 corresponds to the first air outlet 423 of the external sleeve 42, the second venting hole 415 of the internal pipe 41 corresponds to the second air inlet 426 of the external sleeve 42, and the second air outlet 424 and the second air inlet 426 of the external sleeve 42 are blocked by the wall of the internal pipe 41. Afterward, the air outside the inflating object enters via the venting pipe 21 of the switch hand-wheel 2, passes through the internal pipe 42 via the connection pipe 8, and then enters the opening 411 of the internal pipe 41 of the air passage switching device 4. The air then enters into the chamber 11 within the pump casing 1 via the first venting hole 414 of the internal pipe 41 and the first air outlet 423 of the external sleeve 42. The air then enters into the blade cap 51 via the air inlet 52 of the air pump 5, and enters into the internal pipe 62 after being pressurized by the blade 55 via the second air outlet 54 of the air pump 5, the second air inlet 426 of the external sleeve 42 of the air passage switching device 4, and the second venting hole 415 of the internal pipe 41. Finally, the air enters into the inflating object via the second opening 412 of the internal pipe 41 and the opened air valve opening 61, as shown in FIGS. 5,6,7,14, and 15.

When the air is deflated from the inflating object, the switch hand-wheel 2 is rotated from a closed position to a deflated shift. The switch hand-wheel 2 drives the connection pipe 3, which is connected with the switch hand-wheel, to move therewith. The connection pipe 3 drives the internal pipe 41 of the air passage switching device 4 to rotate together. The arcuate piece of the internal pipe 41 triggers the power switch 7 to turn on the power source. The air pump 5 starts to operate, and then the second slider 417 of the internal pipe 41 laterally slides to the second lower point A2 within the waved chute 427 of the external sleeve 42. The internal pipe 41 axially moves downward in the external sleeve 42 along therewith, and the diaphragm 413 opens the air valve 6 to make it in an open state. Meanwhile, the first venting hole 414 of the internal pipe 41 corresponds to the first air inlet 425 of the external sleeve 42, the second venting hole 415 of the internal pipe 41 corresponds to the second air outlet 426 of the external sleeve 42, and the first air outlet 423 and the second air inlet 426 of the external sleeve 42 are blocked by the wall of the internal pipe 41. Afterward, the air outside the inflating object enters the chamber 11 in the pump casing 1 via the opened air valve opening 61 the second opening 412 of the internal pipe 42, the second venting hole 415 of the internal pipe 41 and the second air inlet 426 of the external sleeve 42. The air then enters into the blade cap 51 via the air inlet 52 of the air pump 5, and enters into the internal pipe 41 after being pressurized by the blade 55 via the first air outlet 53 of the air pump 5, the first air inlet 425 of the external sleeve 42 of the air passage switching device 4, and the first venting hole 414 of the internal pipe 41. Finally, the air is deflated from the inflating object via the first opening 411 of the internal pipe 41, the connection pipe 3, and the venting pipe 21 of the switch hand-wheel 2, as shown in FIGS. 8,9,10,14, and 15.

When the inflating or deflating operation is stopped, the switch hand-wheel 2 is rotated to a stop shift. The switch hand-wheel 2 drives the connection pipe 3, which is connected with the switch hand-wheel, to move together with the switch hand-wheel 2. The connection pipe 3 drives the internal pipe 41 of the air passage switching device 4 to rotate together. The arcuate piece of the internal pipe 41 triggers the power switch 7 to cut off the power source, and the air pump 5 stop its operations. The second slider 417 of the internal pipe 41 laterally slides to the higher point B in the waved chute 427 of the external sleeve 42. The internal pipe 41 axially moves upward in the external sleeve 42 along therewith, and the diaphragm 413 stops to apply a force on the valve rod 65 of the air valve 6. The air valve returns to the closed state. At this moment, the air inside the inflating object cannot communicate with the outside of the inflating object, as shown in FIGS. 11 through 15.

In addition to above embodiments, there may be other embodiments which can achieve same functions and effects. For example, in this embodiment, the air outlets 53, 54 of the motor 3, the air inlet 425, 426, the air outlets 423, 424 of the external sleeve 42 of the air passage switching device 4 may be combined into one from the present two. In the embodiment, the waved chute 627 of the external sleeve 62 of the air passage switching device 6 in this embodiment passes through the wall of the external sleeve 62. In real scenario, the waved chute 627 may be configured at an inner side of the external sleeve 62, which can achieve same function and effect as above.

What is claimed is:

1. A built-in electric air pump for an inflating object, comprising:

a pump casing, a switch hand-wheel, a connection pipe, an air passage switching device, an air pump, an air valve and a power switch, wherein:

the pump casing is a box-shaped chamber; the connection pipe, the air passage switching device and the air pump are provided within the chamber of the pump casing; the air valve is provided at bottom of the pump casing; a panel with an opening is provided at a top portion of the pump casing; the switch hand-wheel being provided at an external lateral side of the panel; the air passage switching device is provided with an internal pipe disposed on a center axis, the internal pipe having a first opening and a second opening respectively arranged at an upper end and a lower end of the internal pipe; the first opening communicates with outside space of the inflating object via the connection pipe; the second opening communicates with the air valve; a diaphragm is provided inside the internal pipe for separating inside of the internal pipe into two air separated sections as a top section and a bottom section; a first venting hole and a second venting hole are respectively provided on internal walls of the internal pipe of the top section and the bottom section that are axially spaced from one another and above and below the diaphragm; an external sleeve is provided outside the internal pipe; a third opening and a fourth opening are respectively provided at an upper end and a lower end of the external sleeve; an inner wall of the external sleeve corresponds with an outer wall of the internal pipe; the lower end of the external sleeve is fixedly connected to the pump casing and the lower end of the external sleeve correspondingly communicates with the air valve; a wall of the external sleeve is provided with an air outlet communicating with an air inlet of the air pump, and the wall of the external sleeve is provided with an air inlet communicating with an air outlet of the air pump; an upper end of the connection pipe is connected to and communicates with the switch hand-wheel; a lower end of the connection pipe is muff-coupled with the upper end of the internal pipe; and the diaphragm of the internal pipe contacts a valve rod of the air valve such that the valve is opened by an applied external force along the center axis and the diaphragm and the value are moved together.

2. The built-in electric air pump for an inflating object according to the claim 1, wherein the internal pipe of the air passage switching device comprises three variable positions, and when the internal pipe is at a first position, the first venting hole and the second venting hole of the internal pipe respectively communicate with the air outlet and the air inlet of the external sleeve such that air flows from outside of the inflating object to the inside of the inflating object; when the internal pipe is at a second position, the first venting hole and the second venting hole of the internal pipe respectively communicate with the air inlet and the air outlet of the external sleeve such that the air flows from the inside of the inflating object to the outside of the inflating object; and when the internal pipe is at a third position, both the first venting hole and the second venting hole of the internal pipe have not communicated with the air inlet and air outlet of the external sleeve.

3. The built-in electric air pump for an inflating object according to the claim 1, wherein an outer surface of the internal pipe of the air passage switching device is provided with at least one first slider matching with the connection pipe and at least one second slider matching with the external sleeve.

4. The built-in electric air pump for an inflating object according to the claim 3, wherein the internal pipe is provided with a flange extending between the at least one first slider and the at least one second slider, an arcuate piece is provided at an edge of a top surface of the flange, and the arcuate piece moves together with the power switch arranged at a side of the arcuate piece.

5. The built-in electric air pump for an inflating object according to the claim 3, wherein a wall of the external sleeve of the air passage switching device is provided with a laterally-slidable wave chute lower at two lateral ends and higher at middle, and the waved chute matches with the at least one second slider of the internal pipe.

6. The built-in electric air pump for an inflating object according to the claim 3, wherein at least one linear groove is provided at a lower part of an inner wall of the connection pipe, and the at least one linear groove matches with the at least one first slider of the internal pipe.

7. The built-in electric air pump for an inflating object according to the claim 1, wherein a flange having a diameter larger than an opening of the front panel is provided at a top end of the connection pipe, and at least one boss being fixedly connected to the switch hand-wheel is provided on an upper surface of the flange.

8. The built-in electric air pump for an inflating object according to the claim 1, wherein the air pump comprises a blade cap fixedly connected to the pump casing, a blade provide within the blade cap, and a motor provided within the chamber of the pump casing, the blade cap is provided with an air pump inlet and an air pump outlet, and an end of a shaft of the motor is connected to the blade by passing through the blade cap.

9. The built-in electric air pump for an inflating object according to the claim 1, wherein the air valve is provided at bottom of the pump casing, and the air valve comprises a valve piece, a sealing ring, a valve rod, a spring and a valve rod cap, an air valve opening of the pump casing is provided with an air valve supporting bracket, a through hole is provided at a center of the air valve supporting bracket, the valve rod is provided within the through hole of the air valve supporting bracket, upper and lower ends of the valve rod are respectively provided with the valve rod cap and the valve piece, the sealing ring is provided at a rim of the valve piece, the valve rod cap is muff-coupled between a periphery of the valve rod, the air valve supporting bracket and the valve rod cap, a meshed protection cap for protecting the air valve is provided at the air valve opening of the pump casing.

10. The built-in electric air pump for an inflating object according to the claim 1, wherein the switch hand-wheel is provided with a venting pipe.

11. The built-in electric air pump for an inflating object according to claim 1, wherein the internal pipe is provided with a first slider and a second slider with a flange there between, an arcuate piece is provided at an edge of a top surface of the flange, and the arcuate piece moves together with the power switch arranged at a side of the arcuate piece.

12. The built-in electric air pump for an inflating object according to the claim 1, wherein a wall of the external sleeve of the air passage switching device is provided with a laterally-slidable wave chute lower at two lateral ends and higher at middle, and the waved chute matches with a second slider of the internal pipe.

13. The built-in electric air pump for an inflating object according to the claim 1, wherein at least one linear groove is provided at a lower part of an inner wall of the connection pipe, and the at least one linear groove matches with a first slider of the internal pipe.

* * * * *